US009783404B2

(12) United States Patent
Van Gelder et al.

(10) Patent No.: US 9,783,404 B2
(45) Date of Patent: Oct. 10, 2017

(54) POURING SPOUT FOR DISPENSING A LIQUID PRESENT IN A LIQUID CONTAINER

(71) Applicant: GVG Oliehandel B.V., Nijmegen (NL)

(72) Inventors: Peter Heinz Maria Van Gelder, Winssen (NL); Ernst Bartholomeus Maria Van Gelder, Weurt (NL)

(73) Assignee: GVG Oliehandel B.V., Nijmegen (NL)

( * ) Notice: Subject to any disclaimer, the term of this patent is extended or adjusted under 35 U.S.C. 154(b) by 37 days.

(21) Appl. No.: 14/773,106

(22) PCT Filed: Mar. 7, 2014

(86) PCT No.: PCT/NL2014/050137

§ 371 (c)(1),
(2) Date: Sep. 4, 2015

(87) PCT Pub. No.: WO2014/137216

PCT Pub. Date: Sep. 12, 2014

(65) Prior Publication Data

US 2016/0016780 A1 Jan. 21, 2016

(30) Foreign Application Priority Data

Mar. 7, 2013 (NL) ..... 2010407

(51) Int. Cl.

| | |
|---|---|
| ***B67D 7/00*** | (2010.01) |
| ***B65D 47/06*** | (2006.01) |
| ***B65D 47/32*** | (2006.01) |
| ***B67D 7/04*** | (2010.01) |
| *B65B 39/04* | (2006.01) |
| *B67C 11/00* | (2006.01) |
| *B67D 3/04* | (2006.01) |

(52) U.S. Cl.
CPC ..... *B67D 7/005* (2013.01); *B65D 47/061* (2013.01); *B65D 47/32* (2013.01); *B67D 7/04* (2013.01);
(Continued)

(58) Field of Classification Search
CPC ..... A47G 19/14; B67C 3/00; B67C 2011/30; B67B 1/00; B67D 3/00; B67D 7/005;
(Continued)

(56) References Cited

U.S. PATENT DOCUMENTS 1,345,965 A * 7/1920 Shute ..... B65D 47/283 222/482
3,078,883 A * 2/1963 Beall, Jr. ..... H01M 2/362 137/588

(Continued)

FOREIGN PATENT DOCUMENTS

DE 10238752 B4 9/2010
WO WO9528335 A1 10/1995

*Primary Examiner* — Paul R Durand
*Assistant Examiner* — Andrew P Bainbridge
(74) *Attorney, Agent, or Firm* — Rudy J. Ng; Bret E. Field; Bozicevic, Field & Francis LLP

(57) ABSTRACT

A pouring spout for dispensing a liquid present in a liquid container is provided. The pouring spout includes a first tubular body for connecting to the liquid container and a second tubular body which together with the first tubular body forms a passage for dispensing the liquid. The first and second tubular bodies are telescopically movable here relative to each other for leaving clear a radial opening through which the liquid can leave the pouring spout. The pouring spout further includes a venting channel for drawing in air. The invention is characterized in that the venting channel is fixedly connected to the second tubular body.

17 Claims, 5 Drawing Sheets

(52) U.S. Cl.
CPC ..... *B65B 39/04* (2013.01); *B67C 2011/30* (2013.01); *B67D 3/044* (2013.01)

(58) Field of Classification Search
CPC ... B67D 7/04; B67D 7/44; B67D 7/52; B67D 3/0025; B67D 3/044; B65B 1/04; B65B 3/04; B65B 31/04; B65B 39/04; B65B 39/004; B65D 47/061; B65D 47/32
USPC ..... 222/478–485, 547, 564; 141/2, 18, 39, 141/291–292, 295–296, 309, 335, 352
See application file for complete search history.

(56) References Cited

U.S. PATENT DOCUMENTS 5,076,333 A * 12/1991 Law ..... B65D 47/283 141/198
5,107,909 A * 4/1992 Donovan ..... B67D 7/005 141/198
5,228,487 A * 7/1993 Thiermann ..... B67D 7/54 141/291
5,259,423 A * 11/1993 Simmel ..... B65B 39/04 141/1
5,762,117 A * 6/1998 Law ..... B65D 25/48 141/198
6,227,419 B1 5/2001 Raboin
6,435,380 B1 * 8/2002 Raboin ..... B67D 7/005 141/292
7,089,975 B2 * 8/2006 Chrisco ..... B67D 7/005 141/285
2004/0025968 A1 2/2004 Allen
2010/0078094 A1 * 4/2010 Trippi, Jr. ..... B67D 7/005 141/350
2014/0021222 A1 * 1/2014 Forbis ..... B67D 7/005 222/153.14

* cited by examiner

POURING SPOUT FOR DISPENSING A LIQUID PRESENT IN A LIQUID CONTAINER

The present invention relates to a pouring spout for dispensing a liquid present in a liquid container. Such a pouring spout is generally placed on the liquid container, for instance a jerrycan, in order to then make it possible to transfer liquid from the liquid container to for instance a petrol tank.

Such a pouring spout, as described in the preamble of claim 1, is known from DE10238752B4. The known pouring spout comprises a first tubular body which is adapted at an end thereof for placing on the liquid container, a second tubular body which together with the first tubular body forms a passage for dispensing the liquid, and a closing part placed in axial direction at a distance from the first tubular body. The closing part is fixedly connected here to the first tubular body. The closing part is provided for this purpose with two axial pull rods provided at an end with gripping structures which can engage in corresponding openings in the first tubular body.

The first and second tubular bodies can further move telescopically relative to each other between an open and closed position, wherein in the open position the second tubular body leaves a radial opening at least partially clear between the closing part and the first tubular body and wherein in the closed position the second tubular body blocks the opening.

The known pouring spout also comprises a venting channel for supplying air from outside to the liquid container. This channel extends at least partially in the first tubular body.

In the case of the known pouring spout the closing part is provided with a receiving element for receiving an end of the venting channel. The venting channel is hereby connected fixedly to the first tubular body via the closing part.

This known pouring spout has a number of drawbacks however. It has firstly been found that the total amount of time needed to transfer a given quantity of liquid is in some cases undesirably high. The transfer of liquid usually takes place in two stages. During a first stage the liquid flow is not yet constant. At this stage equilibrium has not been achieved between air supply through the venting channel and liquid discharge through the passage. This results in pulsating pouring. During the second stage such an equilibrium has been achieved, whereby pouring can take place at relatively high speed. It has been found that for some applications the known pouring spout requires an undesirably long time to reach this second stage.

Achieving said equilibrium is especially difficult in the case of "limp" liquid containers. This is because a limp liquid container will first collapse before sufficient underpressure is created in the liquid container to draw the air into the liquid container.

A further drawback lies in the fact that the known pouring spout can become blocked by liquid entering the venting channel. In the most extreme case this will even cause the liquid outflow to stop.

The present invention has for its object to provide a pouring spout in which the above stated drawbacks do not occur, or hardly so.

According to the invention this object is achieved in that the venting channel is fixedly connected to the second tubular body. In the open position of the pouring spout the venting channel will hereby lie considerably higher than the closing part during pouring. It has been found that liquid will hereby be less likely to enter the venting channel, thereby reducing the risk of pulsating pouring. The total amount of time necessary for pouring will also be reduced because the above stated second stage will be reached more quickly.

In the case of "limp" liquid containers the present invention results particularly in an equilibrium being reached sooner between air supply through the venting channel and liquid discharge through the passage. Because equilibrium is reached sooner, it is possible to suffice with relatively limper liquid containers. Such liquid containers require less use of material. A possible explanation for this positive effect, which is given here only by way of example and which should not be interpreted as being limitative, is that because of the lower air resistance of the venting channel during pouring less underpressure is necessary in the liquid container in order to draw in air.

The opening which is left at least partially clear by the second tubular body in the open position is preferably a radial opening.

In the closed position the second tubular body can lie against the closing part for the purpose of closing the passage in axial direction. Possible forms for the closing part are flat components which lie perpendicularly of the passage and/or the venting channel in the closed position.

The closing part can be configured to simultaneously close the venting channel and the passage in the closed position. This has the advantage that when pouring begins, wherein the liquid moves downward through the passage, little or no liquid enters the venting channel. The second stage is hereby reached more quickly, and there is less danger of pulsating pouring or the liquid flow being blocked. The second tubular part can for this purpose have on an end remote from the first tubular body an axial opening which lies in the same plane as an axial opening of the venting tube, which openings of the second tubular body and the venting tube are blocked in the closed position by the closing part.

The venting channel can be formed by a tubular element. Both the venting channel and the first and/or second tubular body preferably take a cylindrical form, preferably with flat outer ends.

The second tubular body can be placed slidably round an outer end of the first tubular body. A telescopic arrangement of first and second tube bodies is hereby achieved, wherein the second tube body moves in the space between the closing part and the first tube body and extends beyond this space on the first tube body side.

The second tubular body can have in axial direction a step in internal dimension which forms a stop for limiting the telescopic movement of the first and second tubular bodies. When the second tube body is moved toward the first tube body, the second tube body can be stopped by the stop.

The closing part can be fixedly connected to the first tubular body. This can for instance be achieved when the closing part comprises a closing surface and an axial connecting part which extends from the closing surface to the first tubular body and is coupled thereto. Other options for connecting the closing part to the first tube body are not precluded. Snap connections are also possible. The second tube body will generally be placed on the first tube body during manufacture of the pouring spout. The closing part will then be placed. It is advantageous from a production engineering viewpoint if this can take place in simple manner, for instance by means of connecting arms with radially extending parts which can fall into corresponding recesses in the first tubular body for snap-fixing of the closing part.

The venting channel can comprise means for at least locally limiting the throughflow speed of air and/or at least locally limiting the entry of the liquid. The pouring spout can thus comprise a non-return valve received in the venting channel for the purpose of preventing liquid entering the venting channel from the liquid container. Limiting the throughflow speed of air can be achieved when the venting channel has a locally smaller inner dimension at an end thereof, preferably the end remote from the closing part. It is noted here that in most situations the venting channel ends in the liquid in the liquid container. The smaller inner dimension will increase the flow resistance to both liquid and air. The balance between air supply and liquid outflow is hereby controllable so that the second stage will be reached sooner. The exact dimensions of such a narrowed portion of the venting channel will also depend on the viscosity of the liquid. Too large an opening is more likely to result in liquid entering the venting channel. Too narrow an opening will limit the air supply unnecessarily, whereby the second stage will not be reached, or not until much later.

The pouring spout can further comprise a resilient element for placing the telescopic movement between the first and second tubular bodies under spring tension. The first and/or second tubular body can be provided with radially protruding edges between which a spring lies enclosed. The use of the above mentioned stop can serve here as safety to prevent damage to the spring.

The second tubular body can be provided with a body protruding in radial direction which is suitable for being engaged by an opening edge of a receiving liquid container for the purpose of movement to the open position. The liquid container will generally comprise fuel and/or oil which has to be transferred to a receiving liquid container such as a fuel tank. The fuel tank here has a filling opening, the edge of which will co-act with the second tubular body such that, when the pouring spout is placed in the filling opening, the edge will move the second tubular body to the second position. The radially protruding body can here ensure that the pouring spout is not too narrow in radial direction, whereby engagement will not take place. Such a protruding body can further serve as a seal during pouring. The protruding body is preferably formed for this purpose by a rubber protruding edge dimensioned such that the opening is sealed as well as possible in as many cases as possible.

The venting channel and the second tubular body can be formed integrally, for instance by manufacturing the two elements from one and the same piece of plastic.

The invention also relates to a pouring spout wherein the closing part comprises a closing surface and an axial connecting part which extends from the closing surface to the first tubular body and is coupled thereto.

According to this aspect of the invention, the pouring spout comprises means for attaching the axial connecting part resiliently to the first tubular body. Such a resilient construction prevents or reduces the risk of damage if the pouring spout falls to the ground. This is particularly important when the pouring spout is still situated on the liquid container, this in respect of the danger of leakage. This aspect can be seen separately from the fixed connection of the venting channel to the second tubular body.

The pouring spout can here comprise a spring placed between the axial connecting part and the first tubular body. The first tubular body and the axial connecting part can further both comprise a support, between which supports the spring is placed. In addition to or instead of a spring it is also possible to use resilient elements or materials in order to achieve the same advantages.

The support in the first tubular body can for instance comprise a structure extending radially in the first tubular body, such as a cross beam. The support in the axial connecting part can for instance comprise a radially extending thickened portion. It is thus possible to place the spring in axial direction between the thickened portion and the cross beam.

The invention will be discussed in more detail hereinbelow making use of the accompanying figures, wherein.

Figure 1:
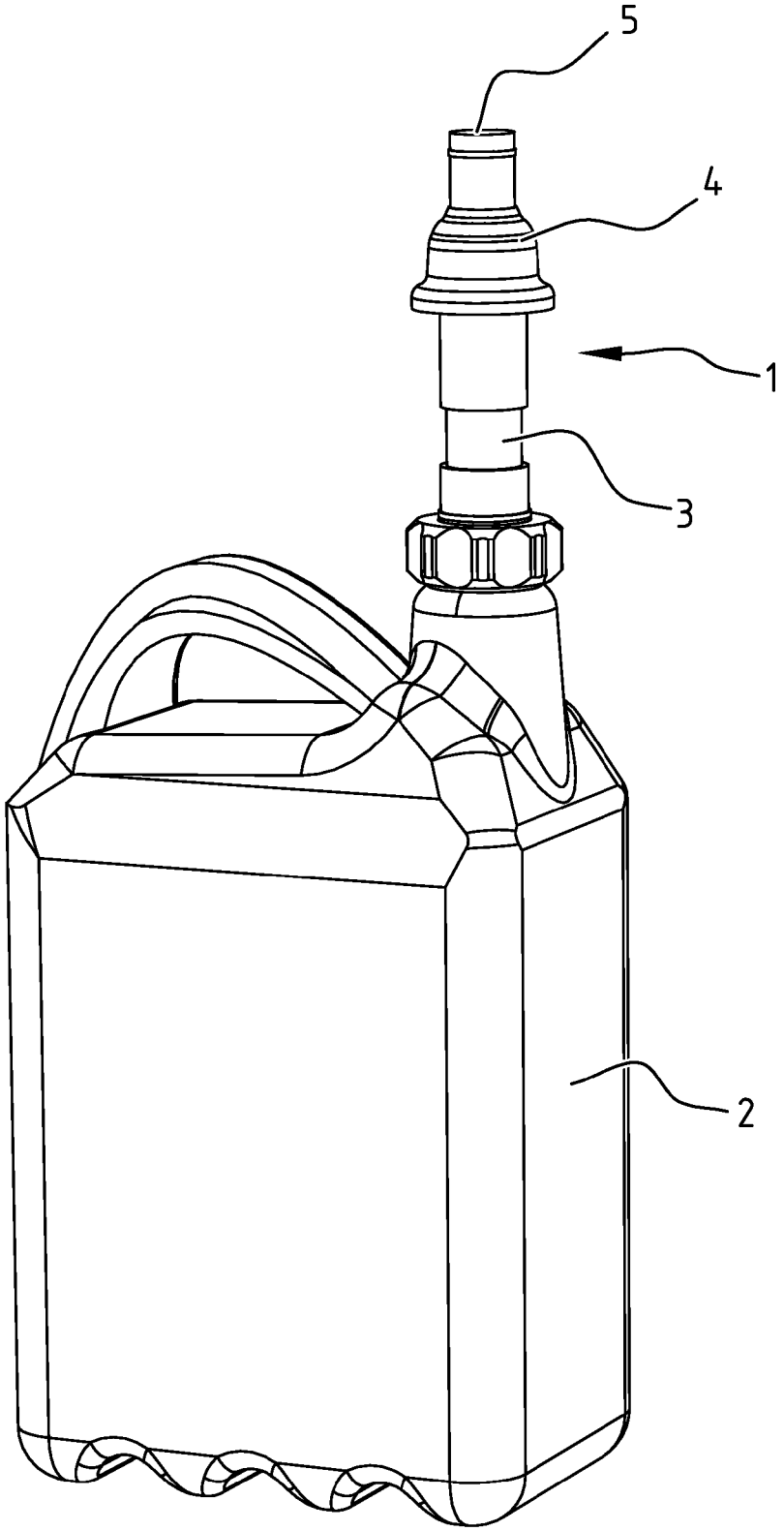
FIG. 1 shows an embodiment of a pouring spout according to the invention.
Figure 3A:
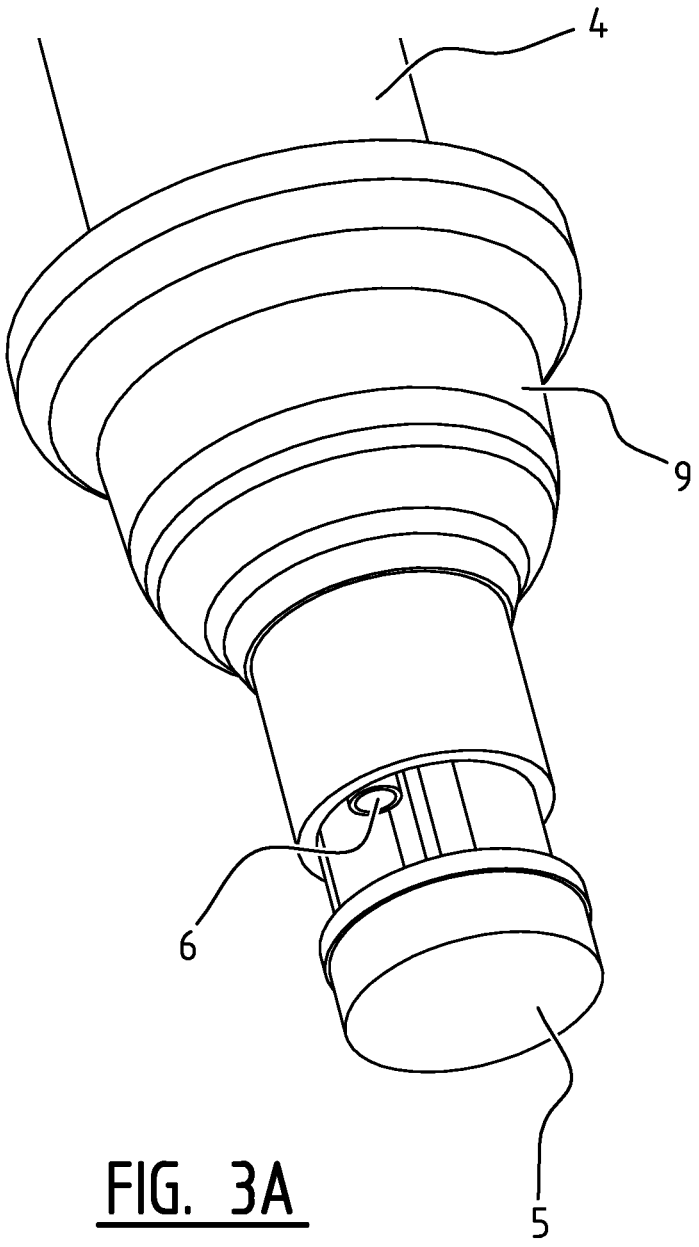
Figure 3B:
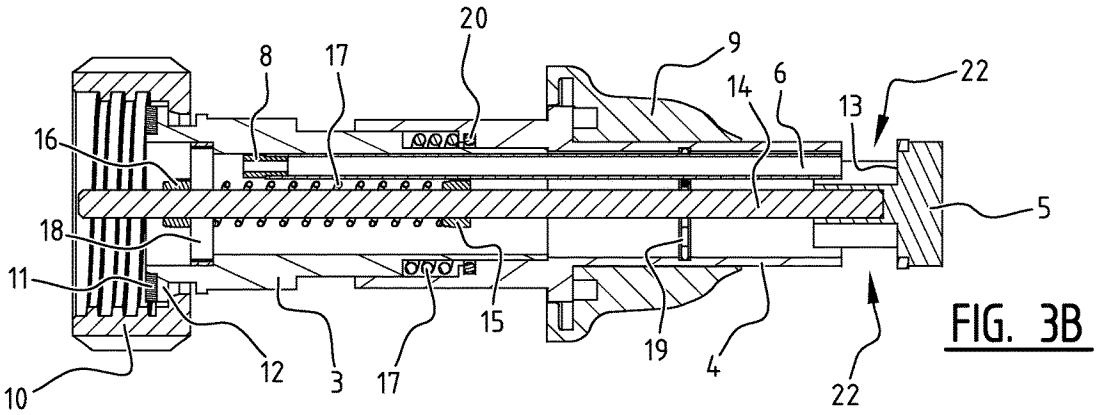
Figure 3C:
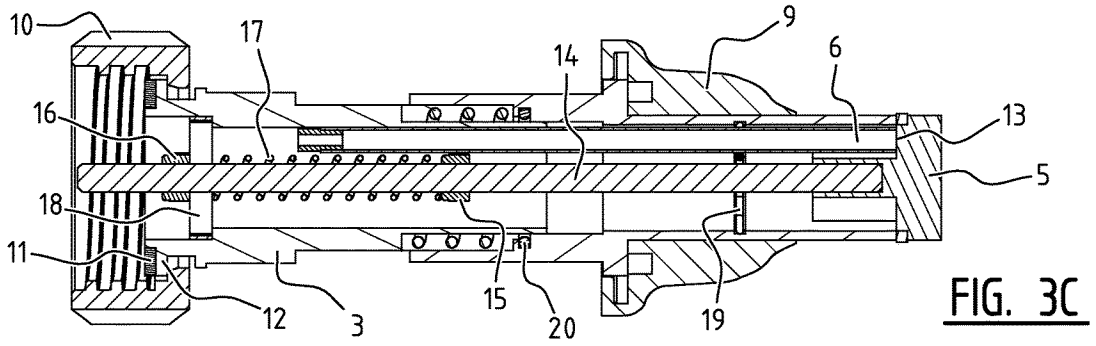
Figure 4:
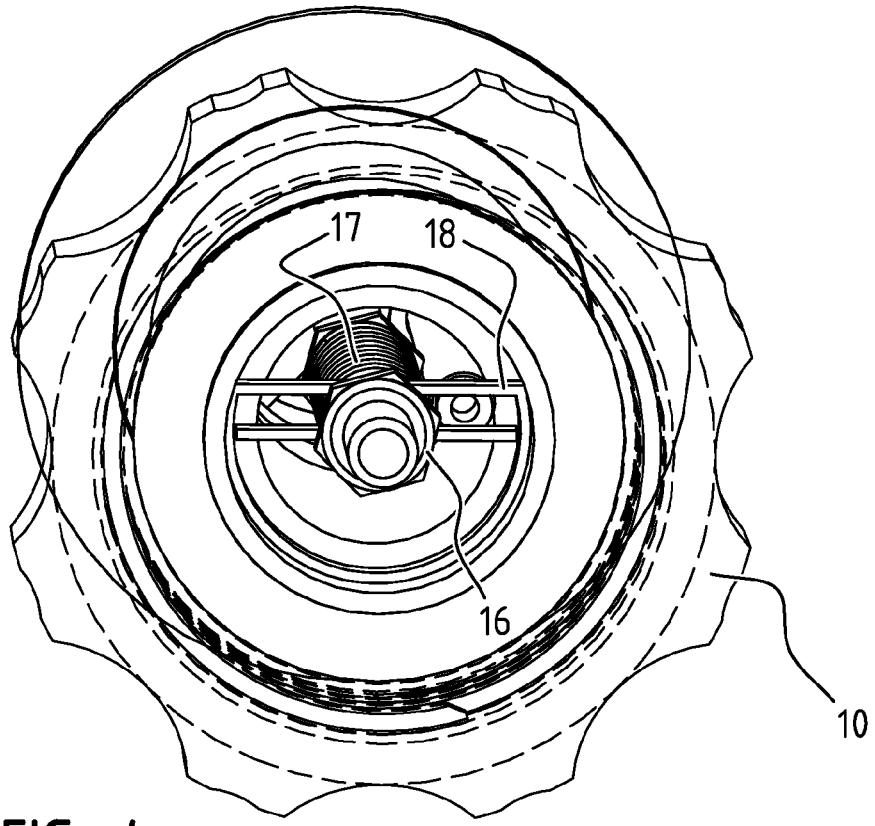

FIGS. 3A-C show respectively a top view and two cross-sections of the pouring spout of FIG. 1;

FIG. 4 shows a bottom view of the pouring spout of FIG. 1; and

Figure 5:
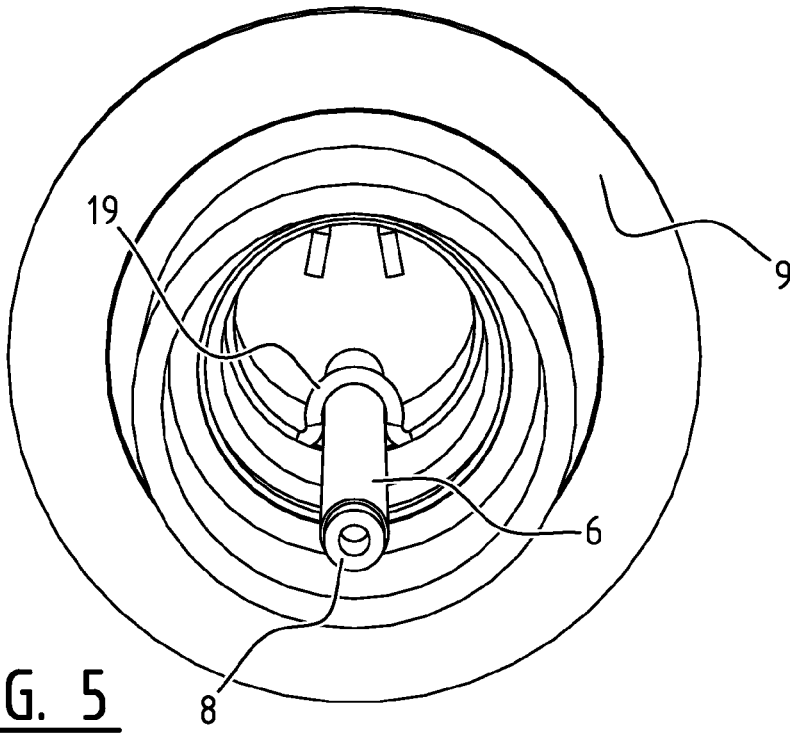

FIG. 5 shows the mounting of the venting channel of the pouring spout of FIG. 1.

Figure 2:
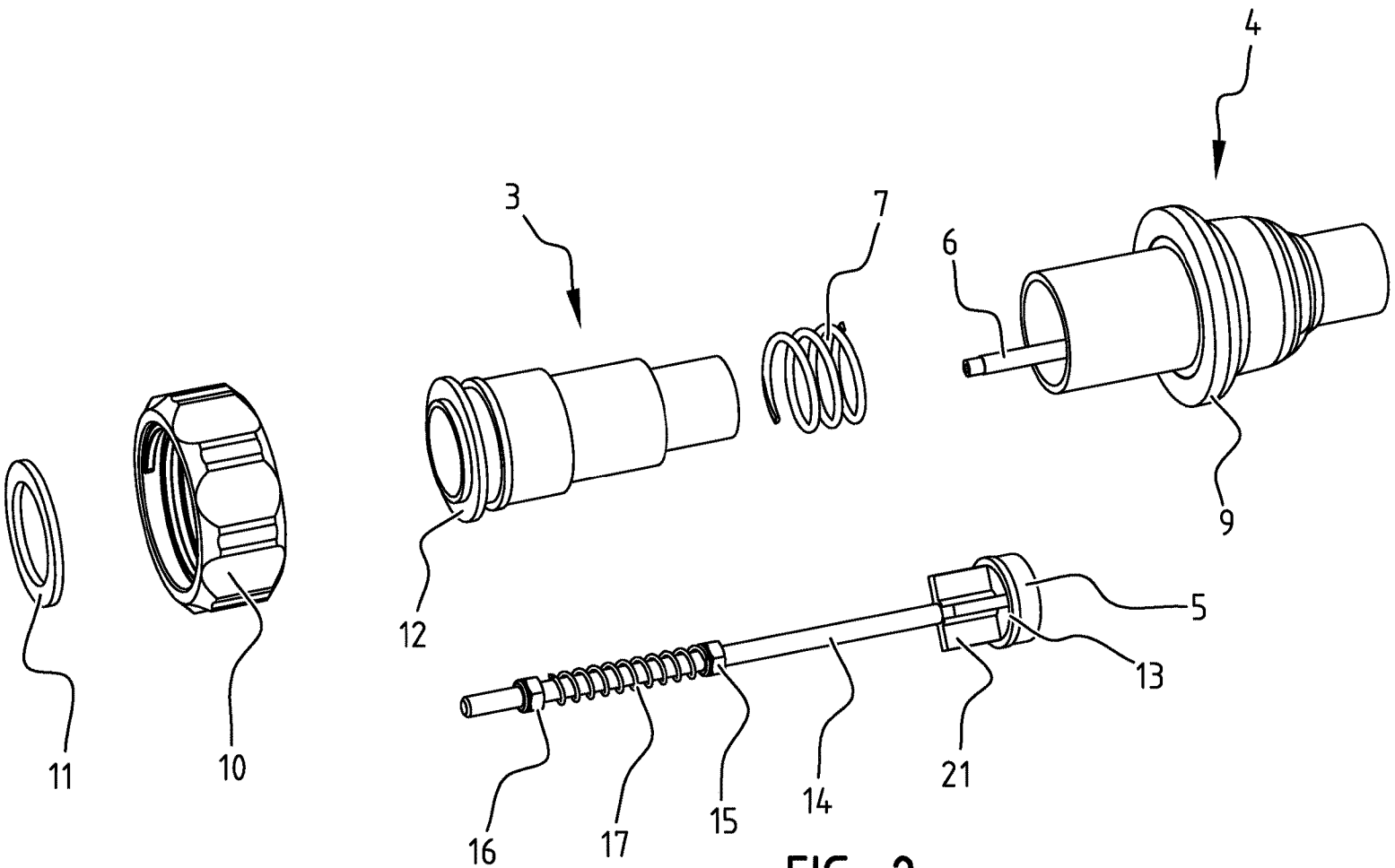
FIG. 2 shows an exploded view of the pouring spout of FIG. 1.

FIG. 1 shows an embodiment of a pouring spout 1 according to the invention which is mounted on a liquid container 2. Pouring spout 1 comprises a first tubular body 3 which is adapted on an underside for mounting on liquid container 2. Pouring spout 1 further comprises a second tubular body 4 which can move telescopically relative to first tubular body 3. Arranged on the upper side of pouring spout 1 is a closing part 5 for axially closing pouring spout 1. More detail of pouring spout 1 can be seen in FIG. 2 which shows an exploded view, in FIG. 3A which shows a top view, and in FIGS. 3B and 3C which show pouring spout 1 in respectively opened and closed position.

Pouring spout 1 comprises a venting channel embodied in the shown embodiment as a tube 6. Tube 6 is fixedly connected here to second tubular body 4.

Second tubular body 4 is placed slidably over an outer end of first tubular body 3. The sliding movement takes place under spring tension of a spring 7. Spring 7 here pushes second tubular part 4 to the closed position, see FIG. 3C.

Tube 6 extends from the upper side of second tubular body 4 into first tubular body 3. Tube 6 is provided on the underside with a decrease in diameter 8 for the purpose of locally increasing the flow resistance. The decrease in diameter 8 can be dispensed with in other embodiments depending on the nature of the target liquid in the liquid container.

Second tubular body 4 is provided with a protruding edge 9 made of resilient material such as rubber. During pouring edge 9 comes into contact with an edge of a filling opening of for instance a fuel tank. This engagement will cause second tubular part 4 to move toward first tubular part 3 and as a result pouring spout 1 will be opened, see FIG. 3B. When pouring spout 1 is removed from the fuel tank, second tubular part 4 will slide to the closed position due to the spring force.

For the purpose of attaching pouring spout 1 to liquid container 2 the spout is provided with a nut 10 provided on the inner side with screw thread corresponding to the screw thread in the edge of the filling opening of liquid container 2. A sealing ring 11, such as an O-ring, which is pressed between nut 10 and flange 12, can be used for sealing purposes.

Closing part 5 comprises a closing surface 13 and an axial connecting part 14. Two nuts 15, 16 and a spring 17 are arranged on connecting part 14. FIG. 4 shows the attachment of closing part 5 in pouring spout 1. First tubular part 3 is provided for this purpose with a transverse connection 18 provided with an opening for receiving axial connecting part 14 therein. During the manufacture of pouring spout 1 second tubular body 4 is first placed over first tubular body 3. Closing part 5 is then placed from the upper side without nut 16 and carried through the opening in transverse connection 18. Use can be made here of guides 21 which support against the inner side of second tubular part 4. Because nut 15 serves as stop for spring 17, spring 17 will be confined between transverse connection 18 and nut 15. Nut 16 is then screwed onto connecting part 14 on another side of transverse connection 18 for fastening thereof. An advantage of this construction is that because of spring 17 closing part 5 is less sensitive to shocks which have to be absorbed by pouring spout 1 if it for instance falls to the ground. This is particularly important when pouring spout 1 is connected to liquid container 2 and this latter contains fuel. This is because, if closing part 5 were to break off, there would be a danger of fuel flowing out of liquid container 2. According to the invention closing part 5 can move downward together with second tubular part 4 for the purpose of absorbing such forces.

For the purpose of fastening tube 6, second tubular part 4 comprises a clip 19 situated in a groove (not shown) in the inner side of second tubular part 4. Clip 19 provides a clamping connection between tube 6 and second tubular part 4. In the context of the present invention it is also possible to give tube 6 and second tubular part 4 an integral form, for instance in plastic.

For the sealing between first and second tubular parts 3, 4 a sealing ring 20 such as an O-ring is received in second tubular part 4.

It will be apparent from FIGS. 3B and 3C that first and second tubular bodies 3, 4 form a passage for liquid from liquid container 2. This passage is blocked in axial direction by closing part 5. Between closing part 5 and the upper side of first tubular body 3 can be identified a radial opening which, irrespective of the position, is at least partially covered by second tubular body 4. In the open position there is a radial opening 22 between closing part 5 and the upper side of second tubular part 4. During pouring the liquid will leave liquid container 2, and air will be drawn in, through these openings 22. In the closed position shown in FIG. 3C openings 22 are covered by second tubular body 4.

It will be apparent from FIGS. 3B and 3C that during movement of second tubular part 4 the tube 6 co-displaces with this part. Tube 6 will hereby be in a higher position than in the known pouring spout. The second stage will hereby be reached sooner during pouring because there is less risk of liquid being taken in. The liquid does after all have a flow which is directed mainly downward at the position of tube 6.

It will be apparent from FIG. 3A that the opening of tube 6 and the opening of second tubular body 4 lie in the same plane. Closing surface 13 of closing part 5 can hereby close both openings effectively in the closed position. As a result there is less risk of liquid being taken into tube 6 prior to pouring, particularly if liquid container 2 and pouring spout 1 are held upside down or very much at an incline, which is usual for pouring purposes.

It will be apparent to the skilled person that the present invention is not limited to the shown embodiments but that the scope of protection is defined by the appended claims. Changes to the shown embodiments are possible here without departing from the scope of protection described by the claims.

It is for instance possible to embody the first tubular body with a bend so that in the position shown in FIG. 1 the second closing part points obliquely upward. Use can optionally be made in this case of other means for connecting connecting part 14 and first tubular body 3.

The invention claimed is:

1. A pouring spout for dispensing a liquid present in a liquid container, comprising:

a first tubular body which is adapted at an end thereof for placing on the liquid container;

a second tubular body which together with the first tubular body forms a passage for dispensing the liquid;

a closing part placed in axial direction at a distance from the first tubular body, wherein the first and second tubular bodies can move telescopically relative to each other between an open and closed position, wherein in the open position the second tubular body leaves an opening at least partially clear between the closing part and the first tubular body and wherein in the closed position the second tubular body blocks the opening; and a venting channel for supplying air from outside to the liquid container, which channel extends at least partially in the first tubular body, said venting channel being fixedly connected to the second tubular body;

wherein:

the closing part comprises a transversely extending closing surface that is configured to simultaneously close or open the venting channel and the passage when arranging the first and second tubular bodies from the open position to the closed position and when arranging the first and second tubular bodies from the closed position to the open position, respectively; and the second tubular body has on an end remote from the first tubular body an axial opening, which axial openings of the second tubular body and the venting channel are blocked in the closed position by the closing surface of the closing part.

2. The pouring spout as claimed in claim 1, wherein the opening is a radial opening.

3. The pouring spout as claimed in claim 1, wherein in the closed position the second tubular body lies against the closing part for the purpose of closing the passage in axial direction.

4. The pouring spout as claimed in claim 1, wherein the venting channel is formed by a tubular element.

5. The pouring spout as claimed in claim 1, wherein the second tubular body is placed slidably round an outer end of the first tubular body.

6. The pouring spout as claimed in claim 1, wherein the second tubular body has in axial direction a step in internal dimension which forms a stop for limiting the telescopic movement of the first and second tubular bodies.

7. The pouring spout as claimed in claim 1, wherein the closing part is fixedly connected to the first tubular body.

8. The pouring spout as claimed in claim 7, wherein the closing part further comprises an axial connecting part which extends from the closing surface to the first tubular body and is coupled thereto.

9. The pouring spout as claimed in claim 8, further comprising a spring placed between the axial connecting part and the first tubular body.

10. The pouring spout as claimed in claim 9, wherein the first tubular body and the axial connecting part both comprise a support, between which supports the spring is placed.

11. The pouring spout as claimed in claim 1, wherein the venting channel comprises means for at least locally limiting the throughflow speed of air and/or at least locally limiting the entry of the liquid.

12. The pouring spout as claimed in claim 11, wherein the venting channel has a locally smaller inner dimension at an end remote from the closing part.

13. The pouring spout as claimed in claim 11, further comprising a non-return valve received in the venting channel for the purpose of preventing liquid entering the venting channel from the liquid container.

14. The pouring spout as claimed in claim 11, wherein the venting channel has a locally smaller inner dimension at an end thereof.

15. The pouring spout as claimed in claim 1, further comprising a resilient element for placing the telescopic movement between the first and second tubular bodies under spring tension.

16. The pouring spout as claimed in claim 1, wherein the second tubular body is provided with a body protruding in radial direction which is suitable for being engaged by an opening edge of a receiving liquid container for the purpose of moving to the open position.

17. The pouring spout as claimed in claim 1, wherein the venting channel and the second tubular body are formed integrally.

* * * * *